US006167628B1

(12) United States Patent
Jones et al.

(10) Patent No.: US 6,167,628 B1
(45) Date of Patent: Jan. 2, 2001

(54) CARPENTER'S GAUGE

(75) Inventors: Steve K. Jones, Nepean; Mark Summers, Sharon, both of (CA)

(73) Assignee: Lee Valley Tools, Ltd., Ottawa (CA)

( * ) Notice: Under 35 U.S.C. 154(b), the term of this patent shall be extended for 0 days.

(21) Appl. No.: 09/141,308

(22) Filed: Aug. 27, 1998

(51) Int. Cl.[7] ..... B43L 9/04

(52) U.S. Cl. ..... 33/27.03; 33/27.02; 33/42.02; 33/42.03

(58) Field of Search ..... 33/42.02, 42.03, 33/27.02, 27.03, 149, 94

(56) References Cited

U.S. PATENT DOCUMENTS

| | | | | |
|---|---|---|---|---|
| 360,213 | * | 3/1887 | Farrell | 33/27.03 |
| 663,168 | * | 12/1900 | Hembree | 33/27 |
| 1,009,214 | * | 11/1911 | Backstrom | 33/27 |
| 1,099,567 | * | 6/1914 | Neukirchen | 33/27 |
| 1,266,845 | * | 5/1918 | Morin | 33/27 |
| 1,488,875 | * | 4/1924 | Franklin et al. | 33/27 |
| 1,539,912 | * | 6/1925 | Peterson | 33/42 |
| 1,972,759 | * | 9/1934 | Burnette | 33/149 |
| 2,400,407 | * | 5/1946 | Gordon | 33/27 |
| 2,438,337 | * | 3/1948 | Gordon | 33/27 |
| 2,505,437 | * | 4/1950 | Skolnick | 33/27.02 |
| 2,656,609 | * | 10/1953 | Siggson | 33/94 |
| 4,976,037 | * | 12/1990 | Hines | 33/27.03 |
| 5,440,818 | * | 8/1995 | Mailhot | 33/452 |
| 5,915,806 | * | 6/1999 | Levee | 33/42 |

FOREIGN PATENT DOCUMENTS

| | | | | |
|---|---|---|---|---|
| 4244533A1 | * | 5/1993 | (DE) | 33/27 |
| 0311710A1 | * | 4/1989 | (EP) . | |
| 267740 | * | 3/1927 | (GB) | 33/27 |
| 2155407 | * | 9/1985 | (GB) | 33/27 |

OTHER PUBLICATIONS

P. 9, Item K, of the 1993/94 Lee Valley Catalog.*

* cited by examiner

*Primary Examiner*—Diego Gutierrez
*Assistant Examiner*—Yaritza Guadalupe
(74) *Attorney, Agent, or Firm*—John S. Pratt; Kilpatrick Stockton LLP

(57) ABSTRACT

A carpenter's gauge for use as a marking gauge or a compass includes a compass bar, a pin carrier, and a marking instrument holder. The compass bar is an elongated bar having a slot formed along its center. The pin carrier slides along the compass bar and includes a pin holder and a knob located opposite the pin holder along the compass bar. The pin holder includes a reference surface that lies substantially in line with a pin held by the pin holder. The knob allows the pin holder to be rotated between a first position where the reference surface lies parallel to the compass bar, and a second position where the reference surface lies perpendicular to the compass bar. When the reference surface lies perpendicular to the compass bar, the gauge may be used as a marking gauge or a compass by inserting a marking instrument into the marking instrument holder. Etched markings along the compass bar indicate the distance between the reference surface or pin and the marking instrument. When the reference surface lies parallel to the compass bar, a nest in the marking instrument holder protects the tip of the pin.

17 Claims, 7 Drawing Sheets

CARPENTER'S GAUGE

BACKGROUND OF THE INVENTION

1. Field of the Invention

This invention is directed to woodworking measuring devices and, more particularly, to a gauge for marking workpieces.

2. Background

Accuracy is often critical in woodworking. Even small measuring errors may compound themselves during construction. For larger projects, such errors may not be noticeable. For example, 1% inaccuracy during the construction of a home might be considered acceptable. For small furniture, however, a 1% error in measurement would probably lead to visible defects in the final product. While such defects might be repaired using common woodworking techniques, an extra minute spent ensuring proper measurements might have prevented several hours of frustration. As a well-known woodworking adage states: "Measure twice, cut once."

Accurate measurement requires proper technique and precise measurement devices. Among the most common measurement devices are squares, rules, compasses, and marking gauges. Squares are steel or aluminum bars with tongues extending from their ends at precise 90° angles. Squares are used to ensure perpendicular arrangements in workpieces and machinery. Rules are wood or metal bars marked with etched markings at predetermined distances. Usually, the rule is graduated in one of the four most commonly used fractions of an inch (8ths, 16ths, 32nds, or 64ths). A combination square combines the rule and the square into a single device that includes an etched rule attached to a movable face perpendicular to the rule.

A compass is used for drawing circles or arcs on a workpiece. The compass includes a fixed point that acts as pivot, and a marking point that marks the workpiece. The marking point may be a pencil or other marking device. The fixed point and a holder for the marking point are attached at their upper ends and may be separated by various angular distances. The compass is operated by placing the fixed point in the workpiece at the desired center of the circle or arc and rotating the marking point about the fixed point.

The marking gauge is used for marking straight lines on a workpiece relative to one edge of the workpiece. The marking gauge includes a handle that extends through a hole in a reference face. The handle includes a fixed pin at one end near the reference face. The reference face includes a screw that allows the face to be moved along the length of the handle. To use the marking gauge, the distance between the reference face and the pin is adjusted to achieve the desired distance between the marking line and the edge of the workpiece. The user then places the reference face flush against a surface of the workpiece and drags the pin along the workpiece using the handle.

Both the compass and the marking gauge have certain drawbacks. First, the desired distances on both devices can be very difficult to measure. Compasses usually don't include markings that indicate the distance between the fixed pin and the marking pin. Instead, the user must usually measure this distance with a rule. Alternatively, the user may calculate the exact distance by measuring the angle formed by the upper ends of the point. This process can be very time-consuming and frustrating. Similarly, marking gauges usually do not feature distance markings. Therefore, the user must measure the distance between the pin and the reference face using a rule or by visual measurement.

Another drawback to both devices is their lack of portability. Both devices are small enough to fit into a carpenter's belt. A folded compass might even fit into a pants pocket. The sharp point on both devices, however, prevents the device from being carried around casually. Indeed, care must be taken when handling these devices to prevent injury to the user.

SUMMARY OF THE INVENTION

The carpenter's gauge described in this application combines many features of a direct-reading compass with those of a marking gauge. The gauge includes etched markings to indicate the desired distance for circle radii or edge markings. A pin holder safely holds a pivot pin to prevent injury to the user.

More particularly, the carpenter's gauge includes a bar with etched markings formed along a surface. The bar includes a groove or slot formed along its interior that allows a rotatable pin carrier to slide along the bar. A marking instrument holder is attached to one end of the bar. The rotatable pin carrier includes a reference surface and a pin aligned with the reference surface. A knob in the pin carrier allows the carrier to be locked in place along the bar. When the knob is released, the pin carrier may be rotated into at least two positions. In one position, the reference face of the carrier lies perpendicular to the bar. In a second position, the reference face of the carrier lies substantially parallel to the bar. In either position, the pin carrier may be moved along the bar to a desired measurement. The marking instrument holder includes protrusions that hold a marking instrument, such as a pencil.

The carpenter's gauge may function as a direct reading compass or a marking gauge. When the reference surface is turned perpendicular to the bar, the carrier may be locked into place at a desired distance. Markings on the bar indicate the radius or diameter of a desired circle or arc. The reference surface may be aligned to a marking on the bar to determine the proper distance. The user inserts the pin into the workpiece and rotates the marking instrument around the pin.

When used as a marking gauge, the marking instrument is inserted in an opposite direction in the holder. The user places the reference surface flush against the workpiece and moves the gauge along the workpiece. Marking instruments other than a pencil may be used to mark the surface of the workpiece.

When the gauge is not in use, the pin carrier may be loosened and rotated to a position where its reference surface lies parallel to the bar. The user may then move the carrier towards the marking instrument holder. A nest formed in an end of the marking instrument holder holds the pin. The carrier may then be locked in place to prevent injury to the user. In addition, the entire gauge may be placed in a shirt or pants pocket for quick access to compass or marking gauge functions.

Accordingly, it is an object of this invention to provide a measuring device that may be used as a compass or as a marking gauge.

It is an additional object of this invention to provide a measuring device that includes measurements for a radius and a diameter of a drawn circle.

It is yet another object of this invention to provide a measuring device that includes measurements for a line drawn along a surface of a workpiece.

It is another object of this invention to provide a measurement device that may accommodate different types of marking devices.

It is a further object of this invention to provide a portable measurement device.

It is an additional object of this invention to provide a measurement device that may be carried safely by a user.

Additional objects and advantages of the invention will be set forth in part in the description which follows and in part will be obvious from the description or may be learned by practice of the invention. The objects and advantages of the invention will be realized and attained by means of the elements and combinations particularly pointed out in the appended claims.

DETAILED DESCRIPTION

Reference will now be made in detail to the invention, examples of which are illustrated in the accompanying drawings. Wherever possible, the same reference numbers will be used throughout the drawings to refer to the same or like parts.

Figure 1:
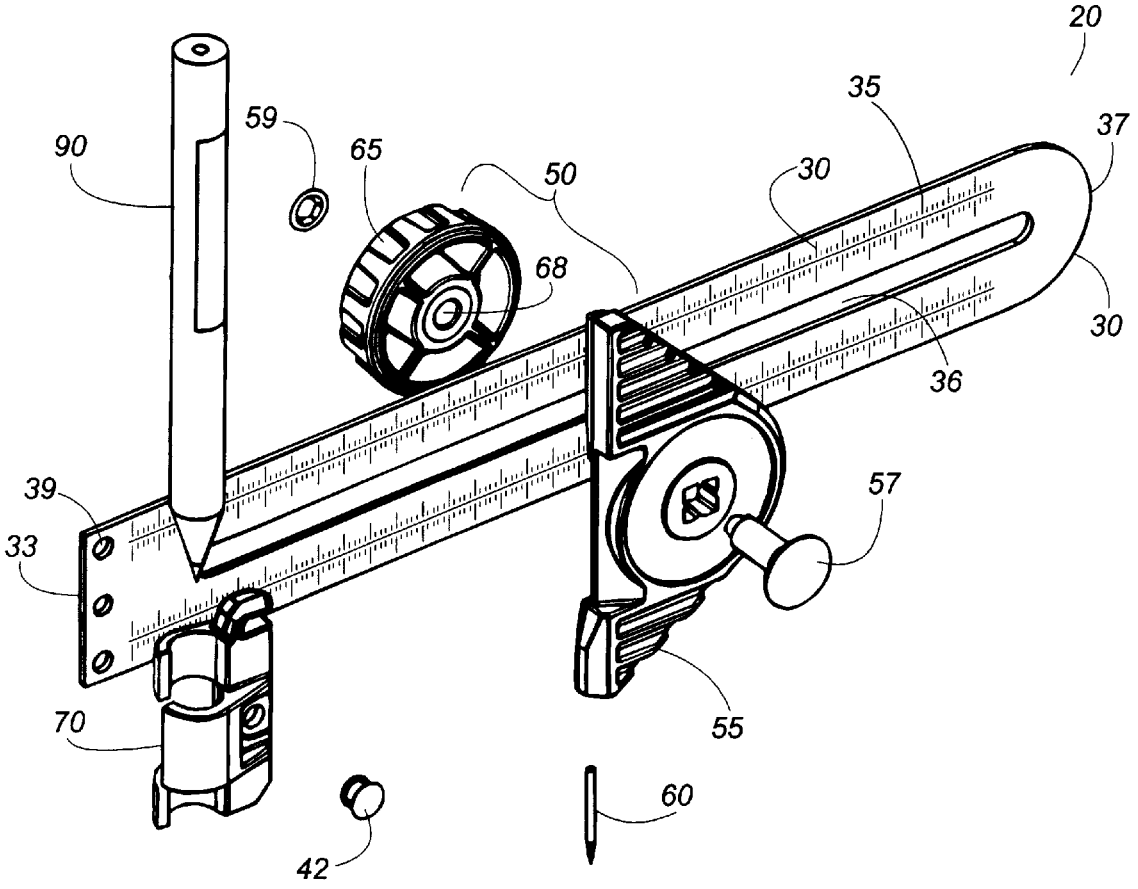
FIG. 1 is an exploded view of a carpenter's gauge, according to the present invention.

FIG. 1 is an exploded view of a carpenter's gauge 20, according to the present invention. The gauge 20 includes a compass bar 30, a slidable pin carrier 50, and a marking instrument holder 70. The compass bar 30 is preferably a stamped stainless steel beam upon which the pin carrier 50 may slide. The bar 30 includes a flat surface 33 extending laterally to a rounded surface 37. A slot 36 in the bar 30 between the flat surface 33 and the rounded surface 37 allows the pin carrier 50 to slide thereon. The bar 30 includes a plurality of apertures 39 for receiving a coupling member 42, such as a rivet. The rivet 42 couples the compass bar 30 to a marking instrument holder 70.

Figure 2A:
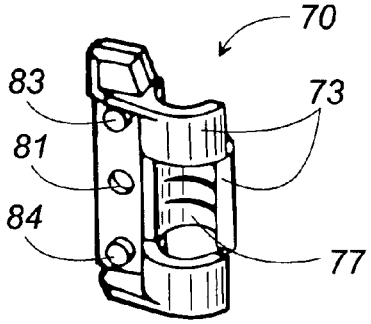
FIG. 2A is a rear perspective view of the marking instrument holder of FIG. 1.
Figure 2B:
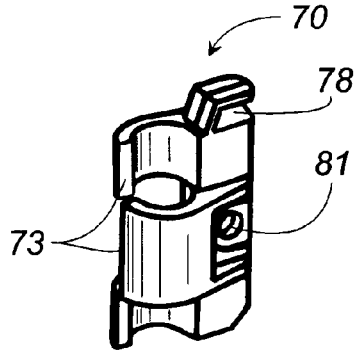
FIG. 2B is a front perspective view of the marking instrument holder.

FIGS. 2A and 2B are rear and front perspective views of the marking instrument holder, respectively. The marking instrument holder 70 is, preferably, a molded plastic member featuring a plurality of protrusions 73. The protrusions 73 are curved to form an enclosure for a marking instrument, such as a pencil 90 (see FIG. 1). It should be apparent that other marking instruments may be used, including but not limited to mechanical pencils, pens, crayons, and pins. The enclosure is formed so as to hold the marking instrument 90 at a 90° angle relative to the length of the compass bar 30. Partial threads 77 are formed along an inner surface of the enclosure to aid in inserting the marking instrument 90. Etched markings 35 on the compass bar 30 specify distances from a center of the enclosure (i.e., the tip of the pencil head) to various positions on the bar 30. Distances may be expressed in English units above the slot 36 in the bar and in metric units below the bar. In addition, both diameters and radii of circles may be indicated.

The marking instrument holder 70 includes at least one aperture 81 for receiving the coupling member 42. Additional round protrusions 83, 84 are formed in the marking instrument holder 70. These additional protrusions 83, 84 mate with two of the apertures 39 in the compass bar 30. In addition, the marking instrument holder 70 includes a pin nest 78 formed therein. The pin nest 78 is a shallow groove for storing a pin 60 coupled to the pin carrier 50 when the pin carrier 50 is not in use.

As illustrated in FIG. 1, the pin carrier 50 includes a pin holder 55 coupled to a knob 65 by a threaded carriage bolt 57 and a push nut 59 or similar fasteners. The carriage bolt 57 passes through the slot 36 in the compass bar 30. The knob 65 includes a tapped bore 68 that receives the threaded bolt 57. The knob 65 may be tightened to lock the pin holder 55 in place, or loosened to allow the pin holder 55 to move along the slot 36. When the knob 65 is fully loosened, push nut 59 prevents the knob from losing contact with the carriage bolt 57. As the knob's thread disengage the carriage bolt threads, the knob 65 tightens against the nut 59. In the fully loosened position, rotation of the knob causes rotation of the pin holder 55 about an axis formed by the carriage bolt 57.

Figure 3A:
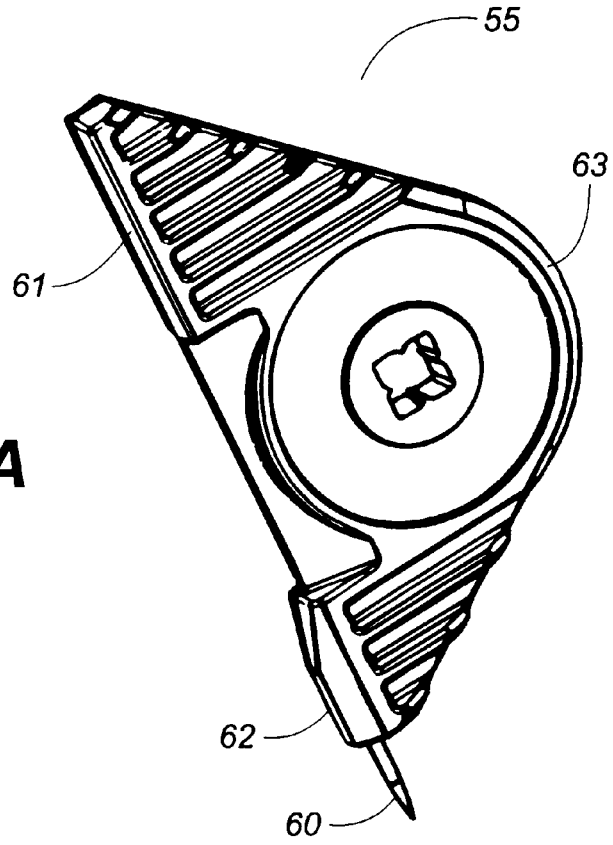
FIG. 3A is a front perspective view of the pin holder of FIG. 1.
Figure 3B:
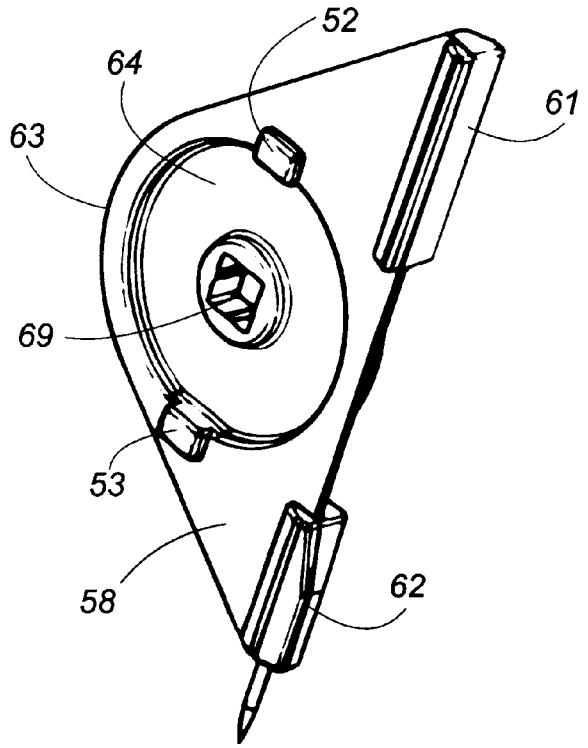
FIG. 3B is a rear perspective view of the pin holder of FIG. 1.

FIGS. 3A and 3B are front and rear perspective views of the pin holder 55, respectively. The pin holder 55 is preferably a plastic member molded into a wing shape, including a first flat surface 61, a second slightly chamfered surface 62, and a third curved surface 63. The first flat surface 61 acts as a reference surface that allows the gauge 20 to be used as a marking gauge (as described in greater detail below). The reference surface 61 lies substantially in line with the pin 60. Thus, both the pin 60 and the reference surface 61 may be used to reference the etched markings 35 along the compass bar 30. The second chamfered surface 62 does not lie parallel to the first surface 61. Instead, the second surface 62 lies slightly proud of the first surface 61 and adjacent to a pin 60 housed in the pin holder. The pin 60 is pressed into the pin holder 55 after the molding process. Once installed, the pin 60 lies substantially in line with the first reference surface 61.

A rear surface 58 of the pin holder 55 includes a circular recess 64. The recess 64 houses a bore 69 that receives the carriage bolt 57. Two protrusions 52, 53 are disposed along a circumference of the recess 64. The protrusions are molded into the plastic form of the pin holder 55 and lie proud of the surface 58. The protrusions 52, 53 are shaped so as to slide within the slot 36 of the compass bar 30 when the pin 60 lies parallel to the compass bar 30. When the pin 60 lies perpendicular to the compass bar 30, the protrusions 52, 53 are spaced so as to contact upper and lower surfaces 32, 34 of the compass bar 30.

Figure 4A:
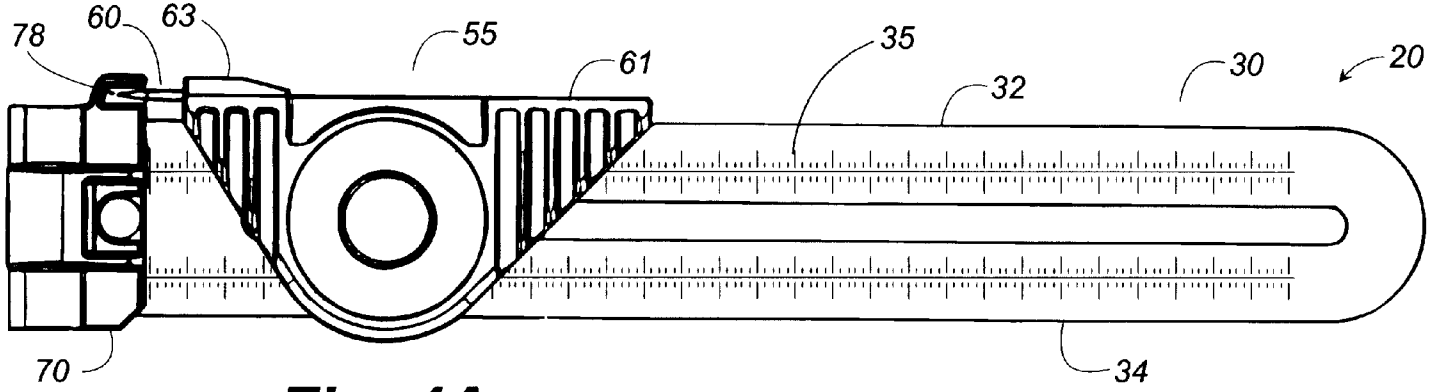
FIG. 4A is a front view of the gauge of the present invention when the pin holder is rotated to a first position.

When the gauge 20 is not in use, the pin holder 55 may be rotated to a position as shown in FIG. 4A. In this position, the pin 60 and first surface 61 of the pin holder 55 lie parallel to upper surface 32 of the compass bar 30. In addition, the pin holder 55 may be moved along the slot 36 of the compass bar 30 until the pin 60 lies within the pin nest 78 of the marking instrument holder 70. The pin nest 78 prevents the pin 60 from accidentally contacting the user. Thus, the user may safely store the gauge 20 in a shirt or pants pocket.

Figure 5:
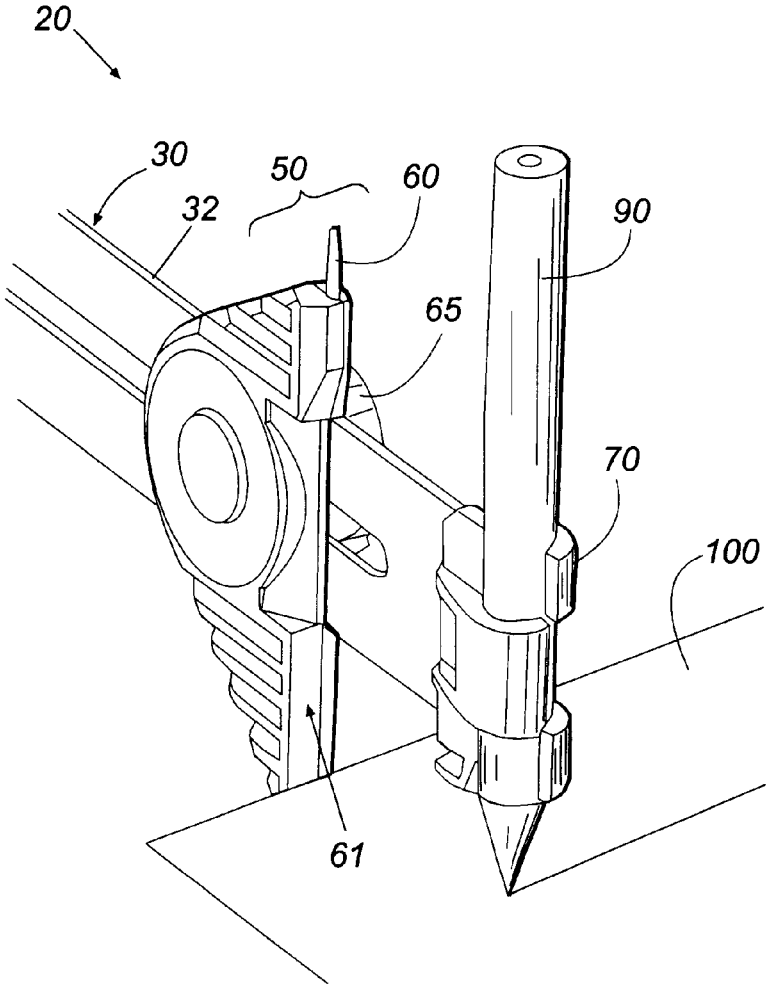
FIG. 5 illustrates the use of the gauge of the present invention as a marking gauge.
Figure 4B:
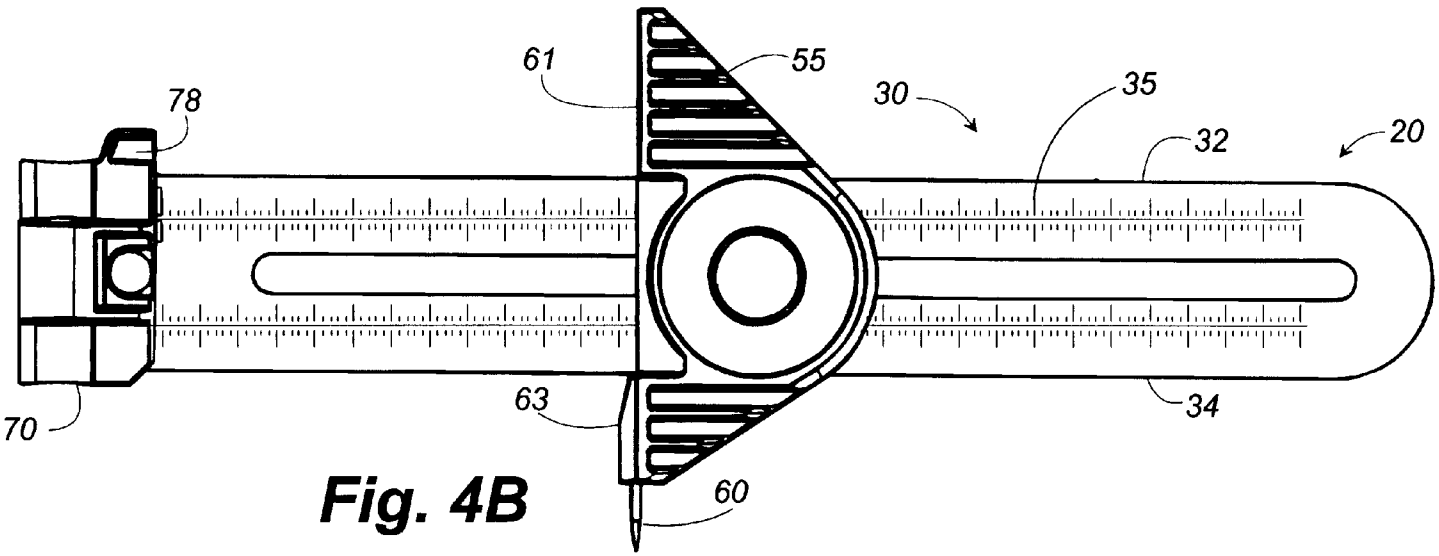
FIG. 4B is a front view of the gauge of the present invention when the pin holder is rotated to a second position.

In use, the knob 65 of the pin carrier 50 may be loosened until it engages the nut 59 (see FIG. 1). The knob 65 may then be used to rotate the pin holder 55 to the position shown in FIG. 4B, where the pin 60 lies perpendicular to an upper surface 32 of the compass bar. The gauge 20 may then be used as a marking gauge or as a compass. FIG. 5 illustrates the use of the gauge 20 as a marking gauge. When used as a marking gauge, a pencil 60 may be inserted into the marking instrument holder 70. The etched markings 35 on the compass bar (not shown in FIG. 5) may be used to adjust the distance between the reference surface 61 of the pin holder 55 and the pencil 90. When the desired distance has been set, the knob 65 is rotated to lock the pin holder 55 in position. The reference surface 61 of the pin holder 55 is placed against the workpiece 100 and the gauge 20 is dragged across the workpiece 100 to draw a line.

Figure 6:
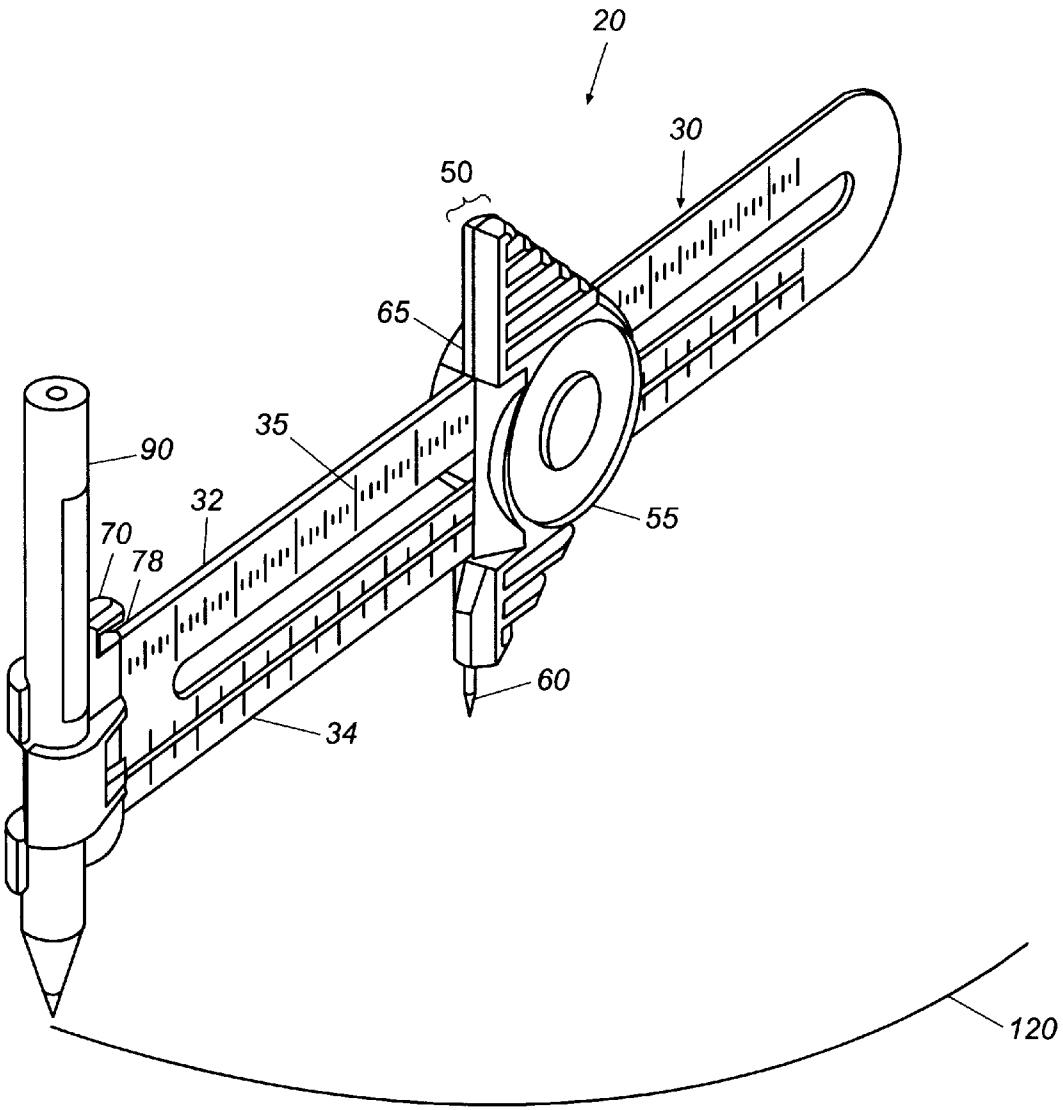
FIG. 6 illustrates the use of the gauge of the present invention as a compass.

FIG. 6 illustrates the use of the gauge 20 as a compass. As in the marking gauge use, a pencil 90 may be inserted into the marking instrument holder 70. The pencil 90 is inserted into the holder 70 in the opposite direction from its marking gauge use. The etched markings 35 on the compass bar 30 may be used to adjust the distance between the pin 60 and the pencil 90. The markings 35 may be inform the user of both the radius and the diameter of a circle 120 to be drawn. The pin 60 may then be placed at the center point of the circle 120. The gauge 20 is rotated about the pin 60 to create a circle.

Figure 7A:
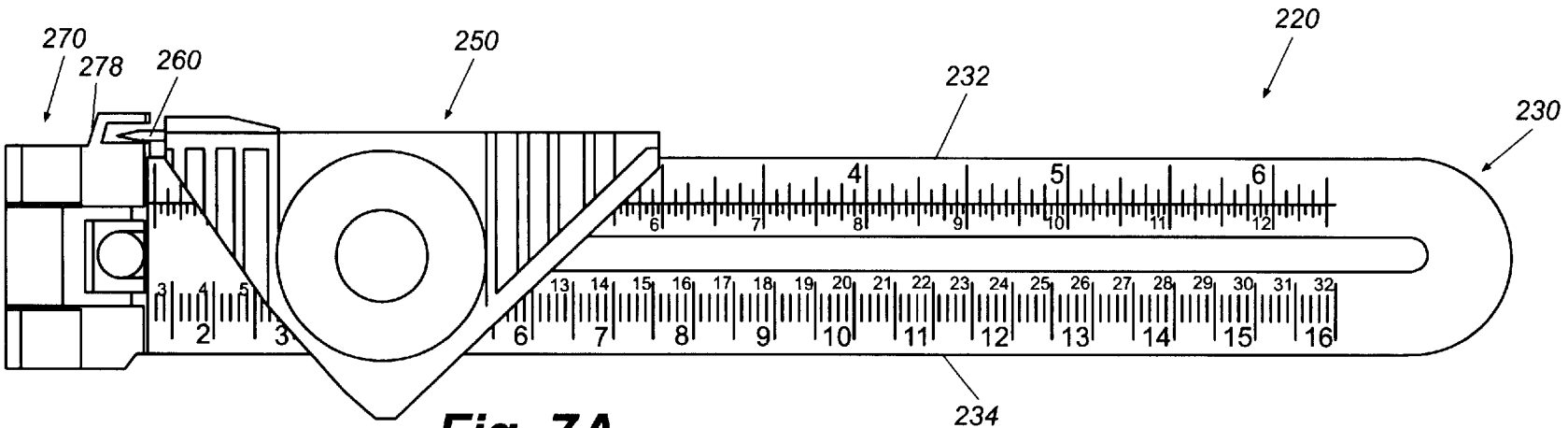
FIG. 7A illustrates another embodiment of the gauge of the present invention.
Figure 7B:
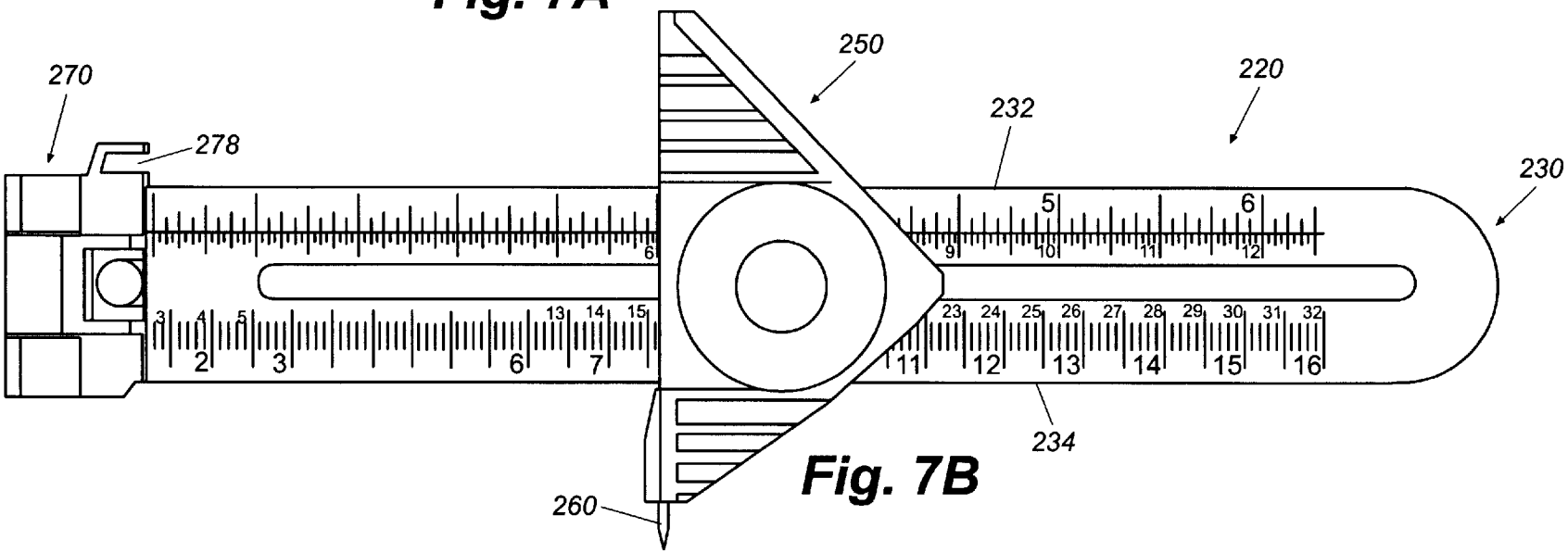
FIG. 7B illustrates the use of the gauge as a compass.
Figure 7C:
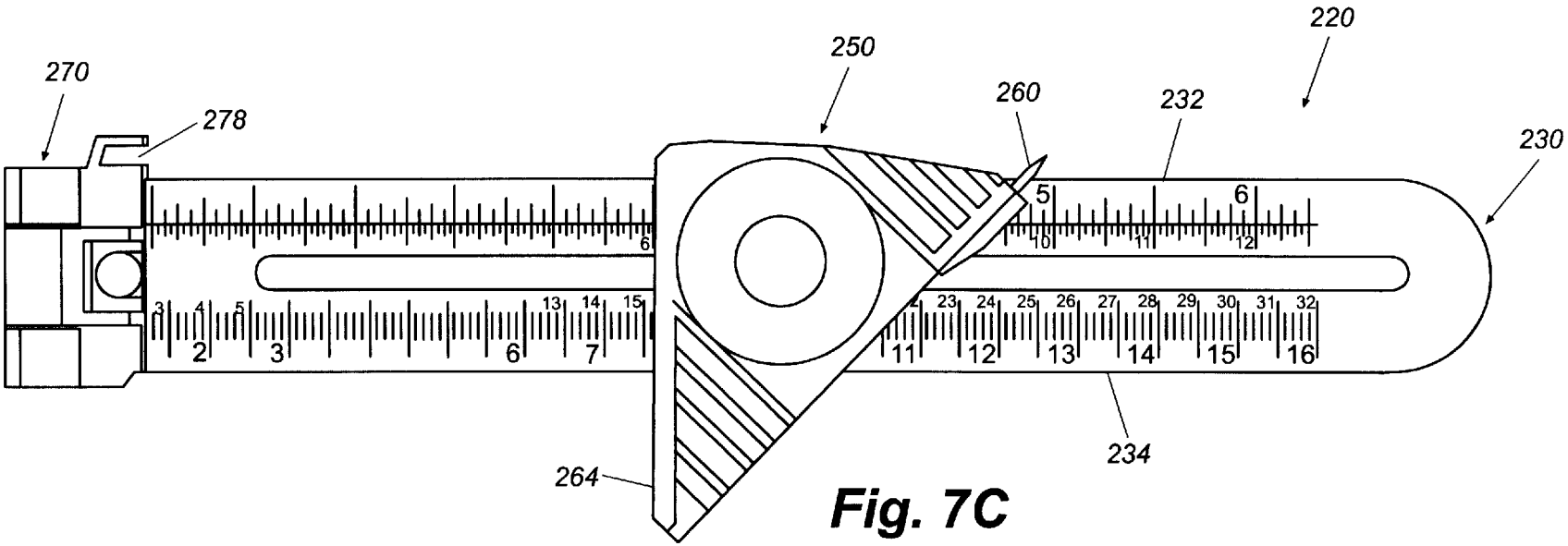
FIG. 7C illustrates the use of the gauge as a marking gauge.

FIGS. 7A–7C illustrate another embodiment of a carpenter's gauge 220. As illustrated, the gauge 220 includes a compass bar 230, a slidable pin carrier 250, and a marking instrument holder 270, as in the previous embodiment. The compass bar 230 and the marking instrument holder 270 are identical in form and function to the compass bar and marking instrument holder of the previous embodiment. The slidable pin carrier 250 is modified to prevent the pin 260 from extending beyond the upper surface 232 of the compass bar 230. In particular, the slidable pin carrier includes a flat surface 264 that acts as a reference surface when the gauge 220 is used as marking gauge.

As illustrated in FIG. 7B, the gauge 220 may operate as a compass by rotating the slidable pin carrier to a position where the pin 260 contacts the surface of a workpiece. Positioning means located along a rear surface of the slidable pin carrier 250 engage the compass bar 230 to lock the pin carrier 250 in place. A marking instrument (not shown) may be inserted into the marking instrument holder 270. The compass bar 230 may then be rotated around the pin 260 to form a circle. FIG. 7C illustrates the use of the gauge 220 as a marking gauge. In this position, the flat surface 264 rests against a surface of a workpiece. The rotation of the slidable pin carrier 250 moves the pin 260 to a position located below the upper surface 232 of the compass bar 230. Thus, the operator is less likely to injure himself while using the gauge 220. When not in use, the pin carrier 250 may be rotated to the position illustrated in FIG. 7A. The pin carrier 250 may slide along the slot formed in the bar 230 until the pin 260 engages a pin nest 278.

Having described a carpenter's gauge, it should be appreciated that various modifications, adaptations, and alternative embodiments thereof, including the use of a retractable pin within the pin carrier to protect the user, for example, may be made within the scope and spirit of the present invention. The invention is further defined by the following claims:

What is claimed is:

1. A carpenter's gauge comprising:

a bar;

a rotatable pin carrier slidably coupling the bar, the pin carrier holding a pin; and a marking instrument holder coupled to an end of the bar, a nest for storing a tip of the pin; said nest being provided on said holder;

wherein the pin carrier may be rotated to a first position having the pin parallel to a length of the bar, and to a second position having the pin perpendicular to the length of the bar.

2. The carpenter's gauge, as recited in claim 1, wherein the nest stores the tip of the pin when the pin carrier is rotated to the first position.

3. The carpenter's gauge, as recited in claim 2, wherein the nest is formed into a surface of the marking instrument holder.

4. The carpenter's gauge, as recited in claim 1, wherein the pin carrier further comprises:

a pin holder carrying the pin;

a knob disposed opposite the pin holder along the bar; and a fastener coupling the pin holder and the knob.

5. The carpenter's gauge, as recited in claim 4, wherein the pin holder includes a plurality of protrusions engaging a slot formed in the bar when the pin carrier is rotated to the first position.

6. The carpenter's gauge, as recited in claim 4, wherein the pin holder includes a plurality of protrusions engaging upper and lower surfaces of the bar when the pin carrier is rotated to the second position.

7. The carpenter's gauge, as recited in claim 4, wherein the pin holder includes a reference surface substantially in line with the pin.

8. The carpenter's gauge, as recited in claim 1, further comprising a marking instrument disposed in the marking instrument holder.

9. The carpenter's gauge, as recited in claim 1, wherein the bar includes a plurality of etched markings thereon indicating distances from the marking instrument.

10. A carpenter's gauge for use as a marking gauge or a compass, the carpenter's gauge comprising:

a compass bar having a slot formed therein;

a rotatable pin holder slidably coupling to the compass bar, the pin holder having a pin and a reference surface substantially in line with the pin; and a marking instrument holder coupled to an end of the bar a nest for storing a tip of the pin; said nest being provided of said holder;

wherein the pin carrier may be rotated to a first position having the pin parallel to a length of the bar, and to a second position having the pin perpendicular to the length of the bar.

11. The carpenter's gauge, as recited in claim 10, wherein the nest is formed into the marking instrument holder.

12. The carpenter's gauge, as recited in claim 10, wherein the compass bar includes a plurality of etched markings indicating distances from a marking instrument inserted in the marking instrument holder.

13. The carpenter's gauge, as recited in claim 10, further comprising a knob disposed opposite the pin holder along the compass bar, the knob allowing rotation of the pin holder to the first and second positions.

14. The carpenter's gauge, as recited in claim 10, wherein the pin holder includes a plurality of protrusions that engage the slot in the compass bar when the pin holder is rotated to the first position.

15. The carpenter's gauge, as recited in claim 10, wherein the pin holder includes a plurality of protrusions that engage upper and lower surfaces of the compass bar when the pin holder is rotated to the second position.

16. The carpenter's gauge, as recited in claim 10, wherein the pin is retractable into the pin holder.

17. A carpenter's gauge comprising:

a bar;

a rotatable pin carrier slidably coupling the bar, the pin carrier holding a pin; and a marking instrument holder coupled to an end of the bar, a nest for storing a tip of the pin, said nest being provided on said holder;

wherein the pin carrier may be rotated to a first position having the pin parallel to a length of the bar, and to a second position having the pin perpendicular to the length of the bar.

* * * * *